US006123583A

United States Patent [19]

Huang

[11] Patent Number: 6,123,583

[45] Date of Patent: Sep. 26, 2000

[54] EMI MASK

[75] Inventor: Wayne Huang, Alhambra, Calif.

[73] Assignee: Hon Hai Precision Ind. Co., Ltd., Taipei Hsien, Taiwan

[21] Appl. No.: 09/243,975

[22] Filed: Feb. 4, 1999

[51] Int. Cl.[7] ..... H01R 13/648

[52] U.S. Cl. ..... 439/607; 439/939; 439/108

[58] Field of Search ..... 439/607, 541.5, 439/939, 108, 540.1, 608, 609, 610; 174/35 GC, 35 R

[56] References Cited

U.S. PATENT DOCUMENTS 5,217,394 6/1993 Ho ..... 439/620
5,752,854 5/1998 Capp et al. ..... 439/607
5,959,244 9/1999 Mayer ..... 174/35 GC
5,975,953 11/1999 Peterson ..... 439/607
5,980,320 11/1999 Slack et al. ..... 439/607

*Primary Examiner*—Renee Luebke
*Assistant Examiner*—Ross Gushi
*Attorney, Agent, or Firm*—Wei Te Chung

[57] ABSTRACT

An EMI mask for use with a connector assembly configured with first and second connectors comprises a plate section defining first and second openings corresponding to the connectors respectively. End tabs extend rearward from transversal ends of the plate for attaching the plate section to a housing of the connector assembly.

15 Claims, 5 Drawing Sheets

EMI MASK

FIELD OF THE INVENTION

The present invention relates to a mask, and more particularly to an EMI mask for use with a stacked connector assembly.

DESCRIPTION OF PRIOR ART 0.8 mm pitch trapezoidal shielded connector is used with very high density cable interconnect (VHDCI) and the Standard Proposal No. 3652-A, issued by Electronic Industries Association, suggests details specification for it. According to the Standard, one of the applications of such connector is the Fixed board right angle stacked, i.e. upper and lower receptacle connectors being stacked together, which can be referred to the copending application Ser. No. 09/053,406 filed Apr. 1, 1998. Each of upper and lower receptacle connectors is shielded with an EMI shroud which surrounds a mating island thereof. Since the upper and lower connectors are manufactured separately, the EMI shrouds thereof are also made separately and assembled respectively for easy assembling wherein interconnecting means is formed on the interface portions, i.e., the longitudinal sides, of both the shroud and the connector housing for securing the shroud to the connector housing. Therefore, when the connectors are stacked based on the interface portions, i.e., the upper longitudinal side of the lower connector and the lower longitudinal side of the upper connector, a gap which is designed to forgiving the possible interference between such interconnecting means of both connectors around the interface portion, is unaviodably formed between the shroud of the upper connector and that of the lower connector. The stacked connector assembly may function well in lower frequency. However, in high frequency application, a gap between the upper and lower EMI shroud becomes a leakage in which the EMI will adversely affect the signal transmission with the cable.

SUMMARY OF THE INVENTION

An objective of this invention is to provide an EMI mask to effectively block the EMI between stacked connectors.

In order to achieve the objective set forth, an EMI mask for use with a connector assembly configured with first and second connectors comprises a plate section defining first and second openings corresponding to the connectors respectively. End tabs extend rearward from transversal ends of the plate for attaching the plate section to a housing of the connector assembly.

According to one aspect of the present invention, a peripheral flange extends forward and inward from a rim of each opening thereby electrically abutting a shroud of the corresponding connector.

These and additional objects, features, and advantages of the present invention will become apparent after reading the following detailed description of the preferred embodiment of the invention taken in conjunction with the appended drawings.

DETAILED DESCRIPTION OF PREFERRED EMBODIMENT

Figure 1:
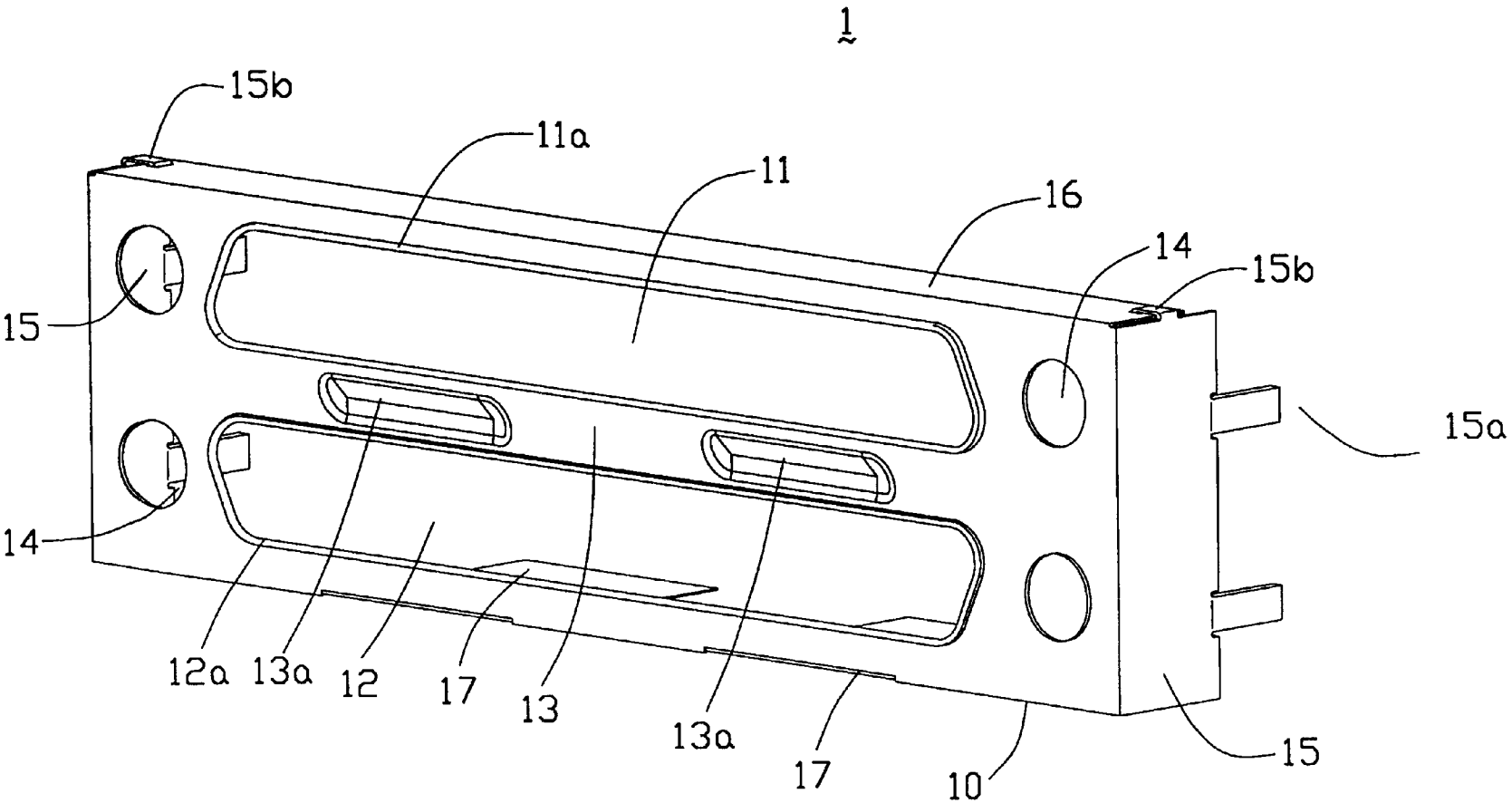
FIG. 1 is a perspective view of an EMI mask in accordance with the present invention.
Figure 2:
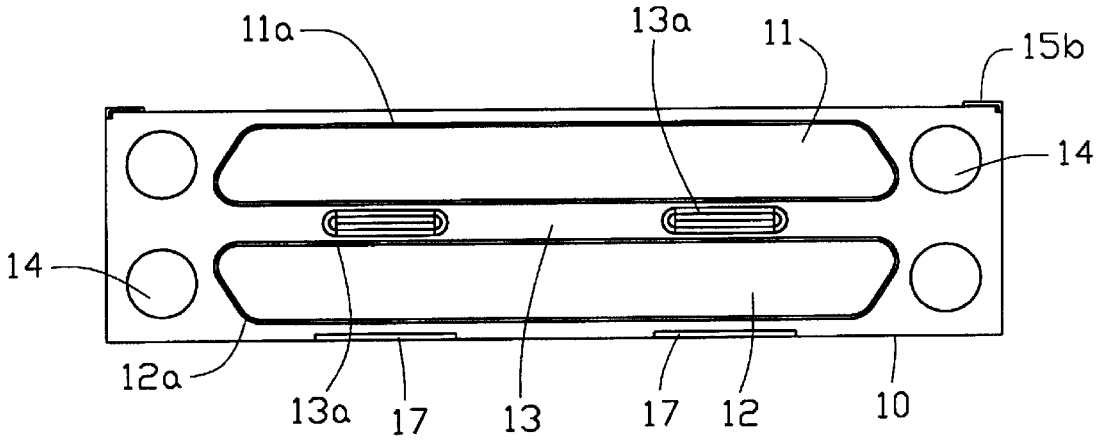
FIG. 2 is a front view of FIG. 1.

Referring to FIGS. 1, 2, 3 and 4, an EMI metal mask 1 in accordance with the present invention comprises a plate section 10 defining first and second D-shaped openings 11, 12. The openings 11, 12 have a trapezoidal shape and are separated by an elongate bar section 13 on which two dimples 13*a* are formed for electrical engagement with the metal shrouds 31*a*, 32*a* of the connectors 31, 32. The plate section 10 further defines four holes 14 for insertion of a bolt member (not shown). End tabs 15 extend rearward from transversal ends 10*a* of said plate section 10 for attaching said plate section 10 to housing 31, 32 of said connector assembly 30. A pair of tail sections 15*a* extends rearward from the end tab 15 for electrical engagement of the aforementioned bolt member. A side flap 16 extends rearward from the upper longitudinal side of the plate section 10 and cooperates with the two end tabs 15 to jointly define a receiving space (not labeled) for reception of the housings 31, 32. The side flap 16 is interlocked with said end tabs 15 by latches 15*b*. Opposite to the side flap 16, a pair of resilient retention tags 17 extend rearward from the lower longitudinal side of the plate section 10 and are adapted to be receiveably engaged within a pair of corresponding recesses (not shown) for retaining the mask 1 to the connector assembly 30.

In addition, each of the openings 11, 12 forms a peripheral flange 11*a*, 12*a* extending forward and inward from a rim (not labeled) thereof. The caliber of the openings 11, 12 is slightly smaller than the outer caliber of shroud 31*a*, 32*a* of the connectors 31, 32 therefore a grounding path between the EMI mask 10 and the shrouds 31*a*, 32*a* is established.

Figure 3:
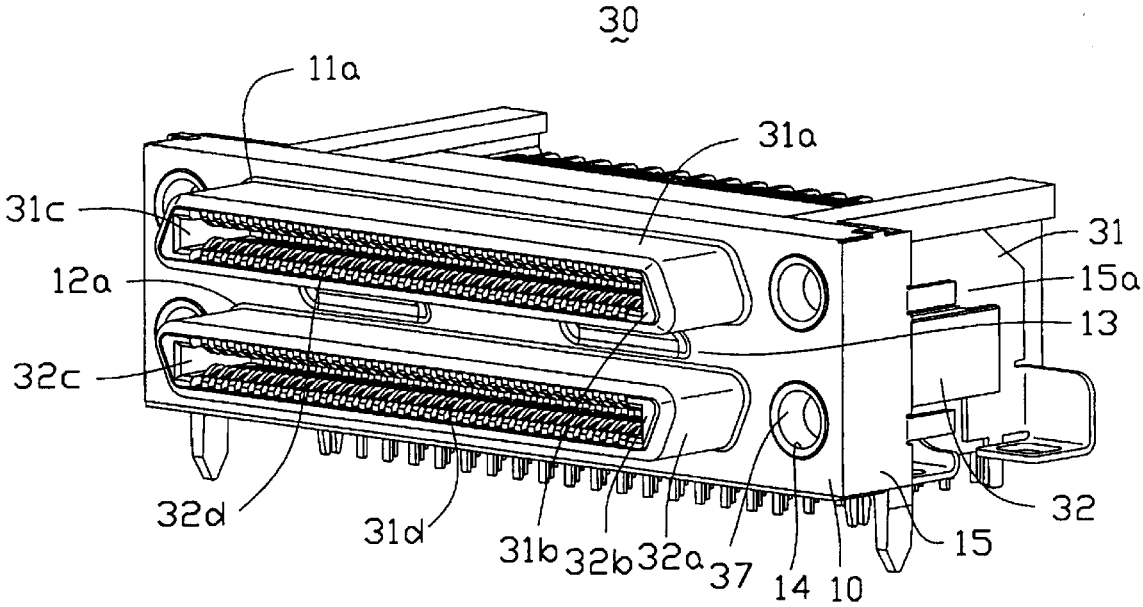
FIG. 3 is a perspective view of a stacked connector assembly with the EMI mask mounted thereon.
Figure 4:
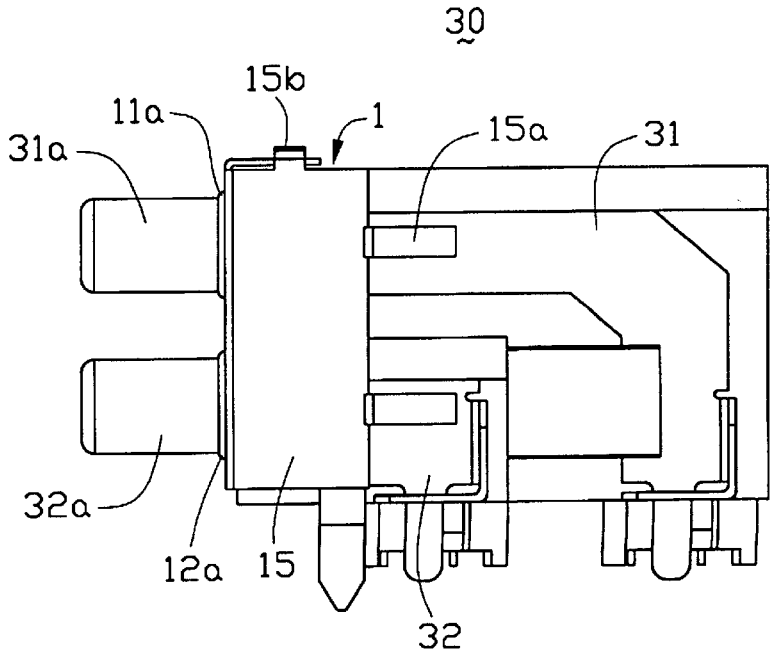
FIG. 4 is a side elevational view of FIG. 3.
Figure 5:
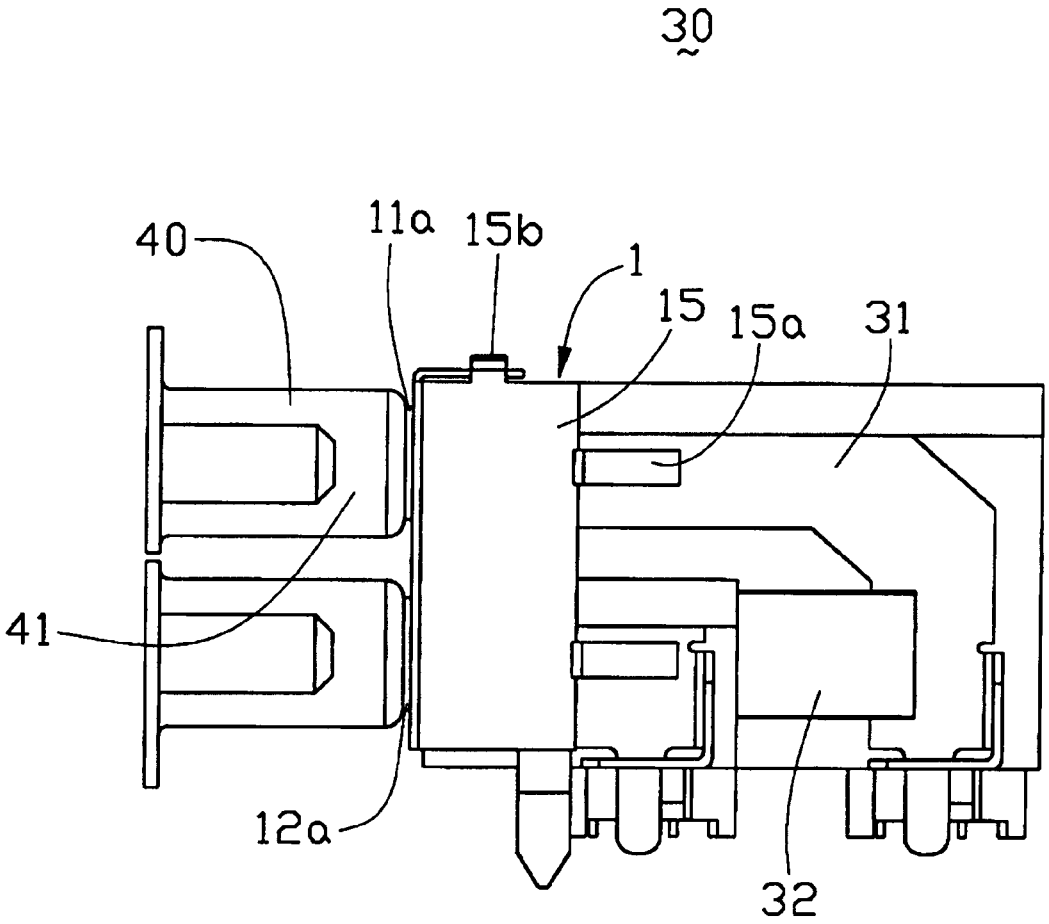
FIG. 5 is a side elevational view of FIG. 3 with plug connectors mated thereto.
Figure 6:
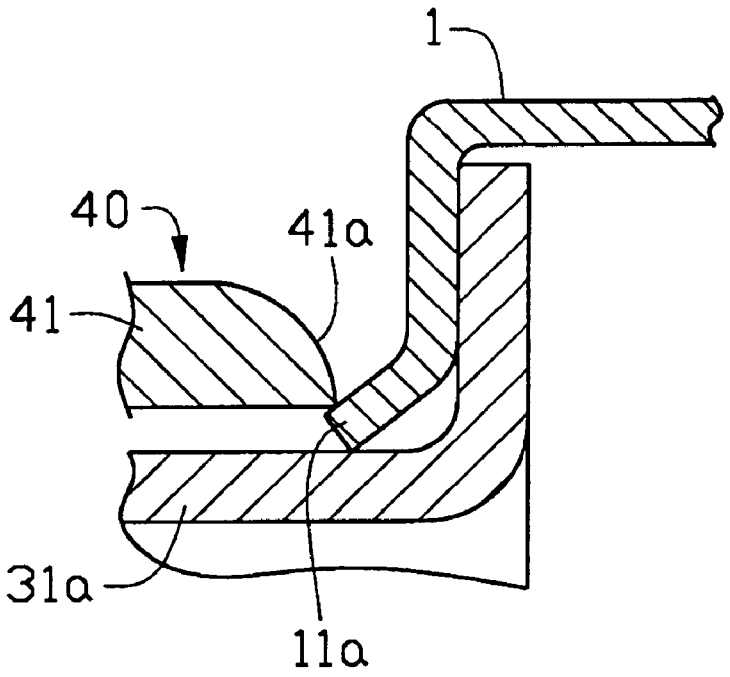
FIG. 6 is an enlarged view showing a flange of the EMI shield is pressed by an inserted EMI shroud from a reverse angle.

Referring to FIGS. 3 and 4, the connector assembly 30 includes the upper receptacle connector 31 and the lower receptacle connector 32. Each connector 31, 32 includes an island section 31*b*, 32*b* defining a cavity 31*c*, 32*c* therein. A plurality contacts 31*d*, 32*d* are assembled therein for mating with a complementary plug connector 40 (FIG.5 or 6). Each island section 31*b*, 32*b* is enclosed with the shroud 31*a*, 32*a*.

Referring to FIGS. 5 and 6, in assembly the island section 31*b*, 32*b* are firstly aligned with the openings 11, 12 respectively. Then the EMI mask 1 is assembled to the connectors 31, 32 whereby the peripheral flange 11*a*, 12*a* is electrically connected with the shroud 31*a*, 32*a*. In addition, when the plug connectors 40 (only a portion is shown) are assembled to the island section 31*b*, 32*b*, a front tip 41*a* of a metal shroud 41 of the plug connector 40 abuts against the corresponding peripheral flange 11*a* (12*a*) thereby enhancing the grounding effect therebetween.

It is noted that the bar section 13 completely and efficiently shields the gap between the upper connector 31 and the lower connector 32 wherein the two mutually reversely positioned openings 11 and 12 are provided by two sides of said bar section 13 for receiving the corresponding island sections 31*a* and 32*b* therein, respectively. Additionally, a pair of holes 14 are provided by two ends of each of the openings 11, 12 in alignment with the corresponding bolt holes 37 of the connector 31, 32 for allowing a bolt to extend therethrough.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

I claim:

1. An EMI mask for use with a connector assembly configured with first and second connectors, each of the first and second connectors comprising a shroud, comprising:

a plate section defining first and second openings corresponding to said connectors respectively, dimples formed on the plate section and located between first and second openings for electrically contacting with the shrouds of the first and second connectors; and end tabs extending rearward from transversal ends of said plate for attaching said plate section to a housing of said connector assembly.

2. The EMI mask as recited in claim 1, further comprising side flaps extending rearward from longitudinal sides of said plate, said side flaps being interlocked with said end tabs.

3. The EMI mask as recited in claim 1, wherein holes are defined on said plate for insertion of bolts.

4. The EMI mask as recited in claim 1, wherein a peripheral flange extends forward and inward from a rim of each of said opening.

5. The EMI mask as recited in claim 5, wherein one of said peripheral flanges electrically connects with a shroud of a complementary connector mated with a respective one of said first and second connectors.

6. An electrical assembly comprising:

an upper connector and a lower connector stacked with each other, each of said upper and lower connectors including a metal shroud; and a metal mask attached to both said upper and lower connectors, said mask including a plate section defining therein an upper opening and a lower opening seperated by a bar section, the bar section forming dimples for electrically contacting with the metal shrouds of the upper and lower connectors; wherein the upper opening receives the shroud of the upper connector and the lower opening receives the shroud of the lower connector so that the bar section may completely and efficiently shield portions of the electrical assembly between the upper and lower connectors.

7. The assembly as recited in claim 6, wherein the mask is electrically engaged with at least one shroud of the connectors.

8. The assembly as recited in claim 6, wherein the mask further includes holes respectively in alignment with corresponding bolt holes in the connectors for allowing bolts to extend therethrough.

9. The assembly as recited in claim 6, wherein at least one retention tag is formed on a lower longitudinal side of the plate section.

10. The assembly as recited in claim 6, further including a complementary connector mated with one of said upper and lower connectors wherein said mask is electrically engaged with another metal shroud of said complementary connector.

11. The assembly as recited in claim 6, wherein said mask further includes two end tabs extending rearward from transversal ends of the plate section for receiving the connectors therebetween.

12. The assembly as recited in claim 11, wherein said mask further includes two tail sections extending rearward from the corresponding end tabs, respectively.

13. The assembly as recited in claim 11, wherein a side flap extends rearward from an upper longitudinal side of the plate section and is adapted to interlock with said end tabs.

14. An electrical assembly comprising:

an upper connector and a lower connector stacked together wherein each of said upper and lower connectors includes a shroud;

a metal mask, said mask including a plate section defining a pair of mutually reversely positioned D-shaped openings separated by a bar section and receiving the shrouds of the upper and lower connectors; and a pair of holes positioned by two ends of each of said openings; wherein said metal mask further integrally forms retaining tags retaining the metal mask to the stacked upper and lower connectors.

15. An electrical assembly comprising:

an upper connector and a lower connector stacked with each other, each of said upper and lower connectors including a metal shroud; and a metal mask attached to both said upper and lower connectors, said mask including a plate section defining therein an upper opening and a lower opening separated by a bar section;

the upper opening receiving the corresponding shroud of the upper connector and the lower opening receives the corresponding shroud of the lower connector so that the bar section may completely and efficiently shield interface portions of the upper and lower connectors; and a complementary connector mated with one of said upper and lower connectors, said complementary connector including another metal shroud; wherein the plate section of the metal mask is generally sandwiched between the metal shroud of one of the upper and lower connectors and said another metal shroud of said complementary connector.

* * * * *